US010299510B1

(12) United States Patent
Rhodes

(10) Patent No.: US 10,299,510 B1
(45) Date of Patent: May 28, 2019

(54) WATER CONDITIONED SMOKING DEVICE

(71) Applicant: Nicholas William Rhodes, San Antonio, TX (US)

(72) Inventor: Nicholas William Rhodes, San Antonio, TX (US)

( * ) Notice: Subject to any disclaimer, the term of this patent is extended or adjusted under 35 U.S.C. 154(b) by 899 days.

(21) Appl. No.: 14/545,081

(22) Filed: Mar. 23, 2015

Related U.S. Application Data

(60) Provisional application No. 61/967,628, filed on Mar. 24, 2014.

(51) Int. Cl.
*A24F 1/30* (2006.01)
*A24F 1/02* (2006.01)

(52) U.S. Cl.
CPC . *A24F 1/30* (2013.01); *A24F 1/02* (2013.01)

(58) Field of Classification Search
CPC ..... A24F 1/30; A24F 1/02
See application file for complete search history.

(56) References Cited

U.S. PATENT DOCUMENTS 3,804,100 A * 4/1974 Fariello ..... A24F 3/00 131/173
3,889,690 A * 6/1975 Guarnieri ..... A24F 1/30 131/173
4,216,785 A * 8/1980 Erickson ..... A24F 1/30 131/173
2007/0261194 A1* 11/2007 Tannous ..... A24F 1/30 15/330
2013/0032159 A1* 2/2013 Capuano ..... A24F 1/30 131/329
2013/0104738 A1* 5/2013 Goldstein ..... B01D 53/14 95/214
2015/0181930 A1* 7/2015 Liu ..... A24F 47/008 131/329

* cited by examiner

*Primary Examiner* — Kevin R Kruer

(57) ABSTRACT

A water conditioned smoking device such as a bong, hookah or the like comprises a source of pressurized air that communicates with a sparger placed in a conditioning water retention chamber of the device such that the pressurized gas enters the chamber below the level of water to be used in the conditioning bath and thereby aerates the bath and smoke. The improved device produces superior smoke conditioning.

14 Claims, 3 Drawing Sheets

WATER CONDITIONED SMOKING DEVICE

CROSS-REFERENCE TO RELATED APPLICATIONS

This application claims the benefit of and priority from provisional application U.S. Ser. No. 61/967,628, filed Mar. 24, 2014.

STATEMENT REGARDING FEDERALLY SPONSORED RESEARCH AND DEVELOPMENT

Not applicable.

NAMES TO THE PARTIES OF A JOINT RESEARCH AGREEMENT

Not applicable

INCORPORATION-BY-REFERENCE TO MATERIAL SUBMITTED ON A COMPACT DISC

Not applicable.

BACKGROUND OF THE INVENTION

1. Field of the Invention

The present invention relates to smoking devices such as hookas, sheeshas, bongs and related smoking devices that include a water bath through which smoke is passed in order to condition same, hereinafter referred to as water conditioned smoking devices. The invention relates as well to the method of use of such devices and the subassemblies, accessories or subcomponents adapted for use in such devices. In water "conditioning" effected by these devices smoke is bubbled through a water bath to cool and humidify it and to remove tars, resins, ash and water soluble irritants and toxins.

2. Description of Related Art

These devices typically comprise (a) an inhalation orifice through which the user inhales the conditioned smoke, (b) a conditioned smoke retention chamber in gas communication with the inhalation orifice, (c) a conditioning water retention chamber capable of holding conditioning water, said chamber in gas communication with the smoke retention chamber, (d) a smoke transfer conduit such as a tube, "tailpiece" or other passageway at least one end of which is oriented so as to terminate below the water (water bath) to be placed in the water retention chamber ("water retention terminus"), and (e) a combustion chamber in gas communication with the smoke transfer conduit distal from the end of the water retention terminus of the smoke transfer conduit. The combustion chamber receives and holds herbaceous matter such as tobacco that is to be burned and smoked.

Smoke transfer conduits, commonly referred to as "tailpieces", typically comprise a water retention chamber terminus and a combustion chamber terminus, the combustion chamber terminus comprising a first coupling member for reversibly and sealably coupling to a combustion chamber, and a second coupling member located between the combustion terminus and the water retention terminus which is capable of reversibly and sealably coupling to a water conditioned smoking device whereby the water retention chamber terminus is disposed below the water surface in the water conditioning bath. "Reversibly and sealably" connected or coupled means that the coupled elements are capable of being serially disconnected, separated and reconnected, but when coupled are capable of transmitting gas or smoke from one element to the other, i.e., "sealably" does not mean that the coupling seals the elements from one another but instead seals the smoke or gas transmission pathway from the atmosphere outside the device.

These devices usually are made from borosilicate glass, plastic or corrosion resistant metals and are designed so that the various elements (typically at least the smoke transfer conduit, combustion chamber and water retention chamber) can be disconnected for cleaning and then reassembled.

The smoke retention and water retention chambers frequently are simply sections of the same tubular member, with the conditioning water retention chamber located towards the bottom of the device when in its intended (usually vertical) orientation for use. The devices are sealed or enclosed between the inhalation orifice and the combustion chamber so that when the user inhales conditioned smoke through the inhalation orifice the gases pulled from the gas retention chamber are only replaced by more smoke drawn out of the combustion chamber.

When smoke is inhaled through the inhalation orifice the prior devices only permit the entry of outside gases or air into the device via the combustion chamber on the other side of the conditioning water bath from the inhalation orifice. This requires the user to labor to pull the entire volume of inhaled gas as smoke through the combustion chamber, thereby producing excessive burn of herbaceous material and minimizing the cleansing effect of the water bath because the entire inhaled volume is smoke, thereby reducing its residence time in the bath.

Attempts have been made to improve the smoke conditioning effect of the water bath. In one the smoke transfer conduit typically terminates in slits or other holes whereby the smoke from the combustion chamber is divided and dispersed into the water bath in the conditioning water retention chamber. Small openings at the terminus of the smoke transfer conduit more efficiently disperse combustion smoke into the water bath and thus improve smoke conditioning. Another arrangement interposes a fritted glass disc in the water bath in the pathway of the smoke. Examples are disc pipes and accessories sold for example by Max Quality Glass under the product category "fritted disc". In a typical embodiment, the body of the device has one or more discs of frit mounted within and completely across the body and internal passageway of the device so that all the smoke is passed through the frit to divide same. In this structure the smoke transfer conduit terminates in the water bath below one or more frit disks immersed in the bath that span the entire smoke passage through the device. The smoke inhaled through the inhalation orifice must necessarily then pass through the frit disc in the water bath. However, both of these options are prone to clogging with resin and ash since smoke must pass through the fine openings in the frit where they become lodged and will rapidly clog up the device, increasing the need for cleaning and the drag required to draw smoke.

This invention also relates to "ash catchers". The purpose of ash catchers is to perform a preliminary water conditioning of smoke by removing ash and other large particulates from the smoke. Ash catchers are typically add-ons to water conditioned smoking devices, i.e., they provide an initial water conditioning to be followed later in the smoke path by another ("secondary") water conditioning bath. Ash catchers are best visualized as a small scale subcomponent version of the water conditioned smoking device, i.e., they comprise a combustion bowl, a chamber for a first water conditioning bath in gas communication with the combustion bowl, and a gas transfer conduit having a coupling member for joining or sealing reversibly to a water conditioned smoking device, more specifically to a chamber for a second water conditioning bath of a water conditioned smoking device. Ash catchers typically are provided separately from water conditioned smoking devices using connecting or coupling members already present on the smoking device, i.e., they are supplemental assemblies or accessories optionally combined with water conditioned smoking devices. They are positioned between and provide a gas transfer route between the combustion chamber and smoke transfer conduit or secondary conditioning water retention chamber.

An ash catcher thus comprises a combustion chamber, a liquid retention chamber, a first smoke transfer conduit communicating with the combustion chamber that extends into the liquid retention chamber below a point at which liquid will be retained within the chamber, a second conduit for drawing gas from the liquid retention chamber at a point above the point at which the surface of the liquid is to be disposed, and a connecting member suitable for sealably and reversibly joining the second conduit to a second connecting member.

Reference is made to U.S. Pat. Nos. 8,534,296, 4,253,475, 4,216,785, 8,490,629 and US Published Patent Application 2010/0126517A1.

BRIEF SUMMARY OF THE INVENTION

In general, the improvements of this invention are achieved by supplying sparged pressurized gas, typically air, to the conditioning water bath of any water conditioned smoking device in order to aid in smoke conditioning. Thus, in accordance with this invention a liquid conditioned smoking device is provided comprising (a) an enclosed body having an inhalation orifice and a smoke receiving orifice for gas communication with a combustion chamber, (b) a connector for reversibly and sealably connecting the smoke receiving orifice to a combustion chamber whereby smoke is passed into the device from the combustion chamber via the smoke receiving orifice, (c) a liquid retention chamber and a conditioned smoke retention chamber, the smoke receiving orifice being in gas communication with the liquid retention chamber and the liquid retention chamber being in gas communication with the conditioned smoke retention chamber, and (d) a source of pressurized gas in gas communication with the liquid retention chamber.

In a water conditioned smoking device having a liquid retention chamber, the improvement comprising a source of pressurized gas in gas communication with said liquid retention chamber.

Also in accordance with this invention is a water conditioned smoking device accessory comprising (a) a source of pressurized gas having a mount for reversibly attaching the source of pressurized gas to a water conditioned smoking device, (b) a conduit for transferring pressurized gas from the source of the pressurized gas to a smoke transfer conduit, said smoke transfer conduit comprising a smoke receiving orifice, a connector for reversibly and sealably connecting the smoke receiving orifice to a combustion chamber whereby smoke is passed into the accessory from the combustion chamber via the smoke receiving orifice, a connector for reversibly and sealably connecting the smoke transfer conduit to a water conditioned smoking device, and (c) a conduit disposed substantially coaxially with the axis of the smoke transfer conduit which is in gas communication with the conduit for transferring gas from the source of pressurized gas, said coaxially disposed conduit being substantially not in gas communication with smoke within the smoke transfer conduit and having its terminus below the level of the liquid conditioning bath in a water conditioned smoking device whereby the source of pressurized gas is in gas communication with the bath.

Further in accordance with this invention a method is provided which comprises (a) providing a device having (i) a combustion chamber, (ii) a liquid retention chamber and a conditioned smoke retention chamber, the combustion chamber being in gas communication with the liquid retention chamber and the conditioned smoke retention chamber in gas communication with the liquid retention chamber whereby smoke is capable of being passed serially from the combustion chamber, the liquid retention chamber and the conditioned smoke retention chamber, and (iii) a source of pressurized gas communicating with the liquid retention chamber,
(b) introducing herbaceous material in the combustion chamber,
(c) introducing a liquid comprising water into the liquid retention chamber
(d) igniting the herbaceous material,
(e) passing smoke from the burning herbaceous material into the liquid in the liquid retention chamber to condition same and then passing the conditioned smoke into the conditioned smoke retention chamber;
(f) introducing pressurized gas into the liquid retention chamber, and
(g) inhaling the conditioned smoke.

BRIEF DESCRIPTION OF THE SEVERAL VIEWS OF THE DRAWINGS

Advantages and features of the present invention will become better understood upon reference to the following detailed description and claims taken in conjunction with the accompanying drawings, wherein like elements are identified with like reference numbers among the figures. Definitions or descriptions of terms set forth in one embodiment shall be construed to mean the same as applied to other embodiments unless otherwise apparent from context.

DETAILED DESCRIPTION OF THE INVENTION

Figure 1:
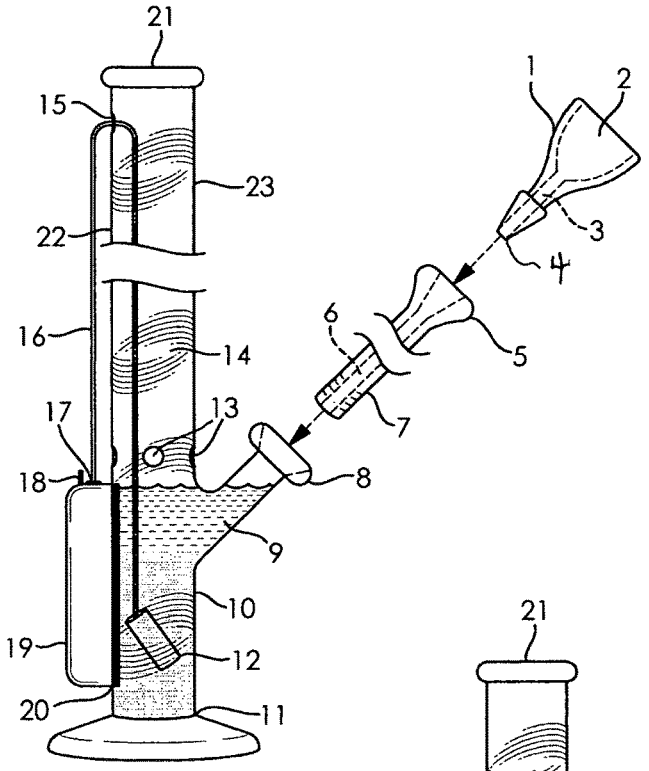
FIG. 1 shows a first embodiment of the water conditioned smoking device of this invention.

In FIG. 1 a bowl 1 containing a combustion chamber 2 and a smoke passage 3 is provided. The bowl terminates in a connector 4, typically a conical body finished in ground glass which inserts reversibly and sealably into the complementary connector 5 in the smoke transfer conduit 6. The smoke transfer conduit 6 terminates in an area of slits 7 or other passages which subdivide the smoke drawn through the smoke transfer conduit 6. The smoke transfer conduit 6 fits into the receptacle 8 which communicates with the liquid retention chamber 10, shown filled with liquid 9. The gas sparger 12 is disposed below the surface of the liquid 9. The sparger is in gas communication with pump 19 via opening 15 in the body 23, gas supply conduit 16 and gas outlet 17 which supplies the gas output of the pump 19. Pump 19, which is actuated by switch 18, is mounted reversibly to device body 23 via Velcro surfaces 20. The source of gas for pump 19, when the gas is air, is an opening for ingress of air (not shown). Also not shown is a power source such as a battery inside pump 19. Optionally, the device body contains indentations 13 extending into the conditioned smoke retention chamber 14 for holding pieces of ice (not shown). Conditioned smoke is retained in chamber 14 before inhalation through the inhalation orifice 21 which in this Figure is a mouthpiece. The device 22 is vertically stabilized by foot 11.

Figure 2:
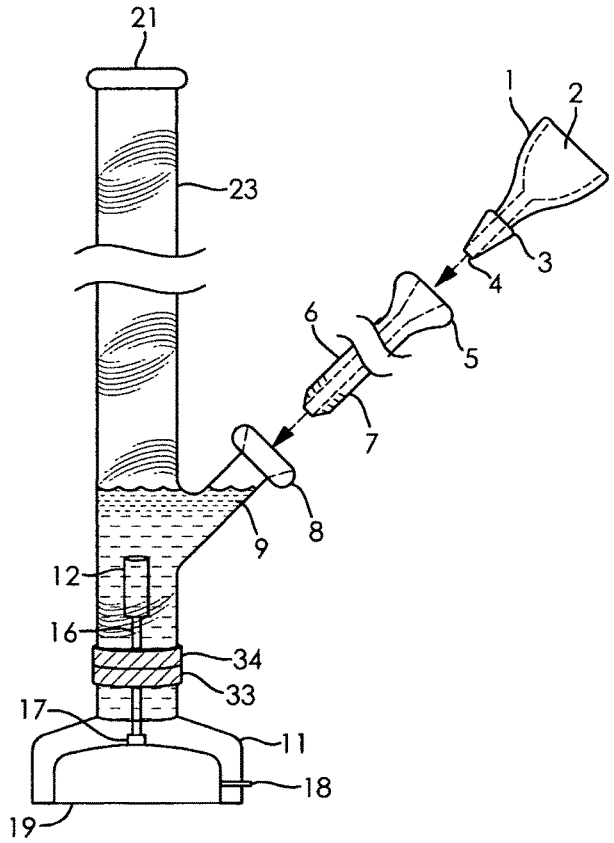
FIG. 2 shows a second embodiment of the water conditioned smoking device of the invention wherein a portion of the liquid retention chamber is detachable and the pressurized gas pump is located in the base of the device.

FIG. 2 depicts an alternative embodiment having the added feature of a detachable segment of the liquid retention chamber which comprises the pump 19, conduit 16 and sparger 12. This allows for more convenient cleaning of the device. The numbered elements are the same as in FIG. 1, except that the base 11 is modified to comprise the pump 19, switch 18, the pressurized gas conduit 16 and the pump connector 17 as well as complimentary connectors 33 and 34 which connects the base with its associated elements to the remainder of the smoking device. Suitable connectors 33 and 34 are threaded male/female members (indicated by hatching) or flanges/rims held together with a clamp (not shown). The connectors optimally are sealed by an o-ring or gasket (not shown). Other connecting elements will be readily apparent to the artisan.

Figure 3:
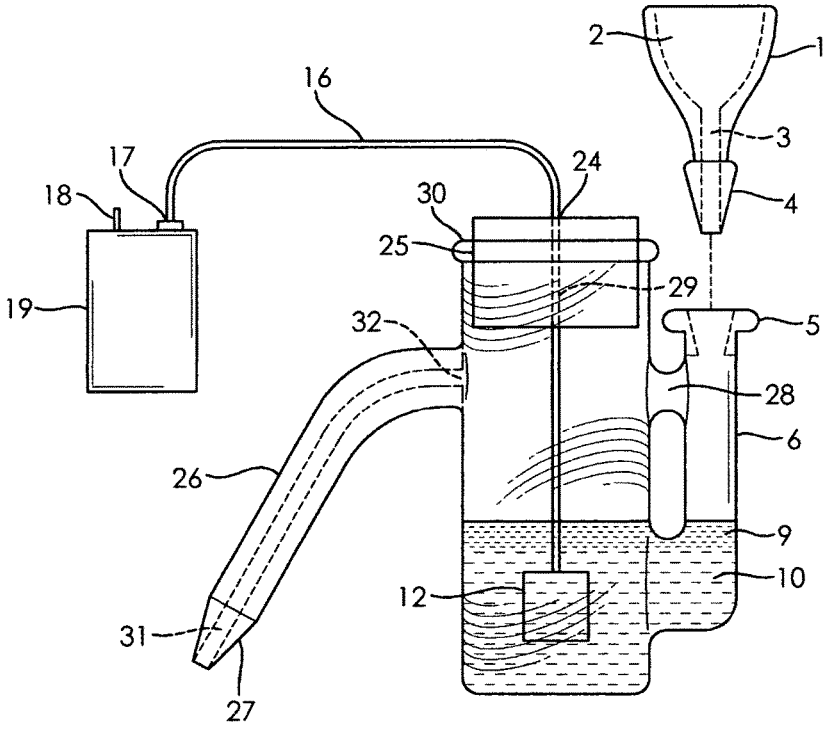
FIG. 3 shows an embodiment of an ash catcher of this invention.

FIG. 3 represents an ash catcher wherein elements in common with the device of FIGS. 1 and 2 are so numbered, and further including an opening 24 and passage 29 in stopper 25 (or a bung assembly 36 as described infra) through which the pressurized gas conduit 16 passes. The stopper 25 is inserted into barrel/rim 30 thereby plugging the opening defined by the rim. The opening 32 is for the passage of conditioned smoke into the conditioned smoke transfer conduit 26, which in turn terminates in a passageway 31 through the connector 27. Connector 27 sealably and reversibly connects with a complementary connector (not shown) found in a water conditioned smoking device (not shown). Strut 28 stabilizes the smoke transfer conduit 6. The pump 19 optionally comprises a mount (not shown) for reversibly attaching the pump to a water conditioned smoking device.

Figure 4:
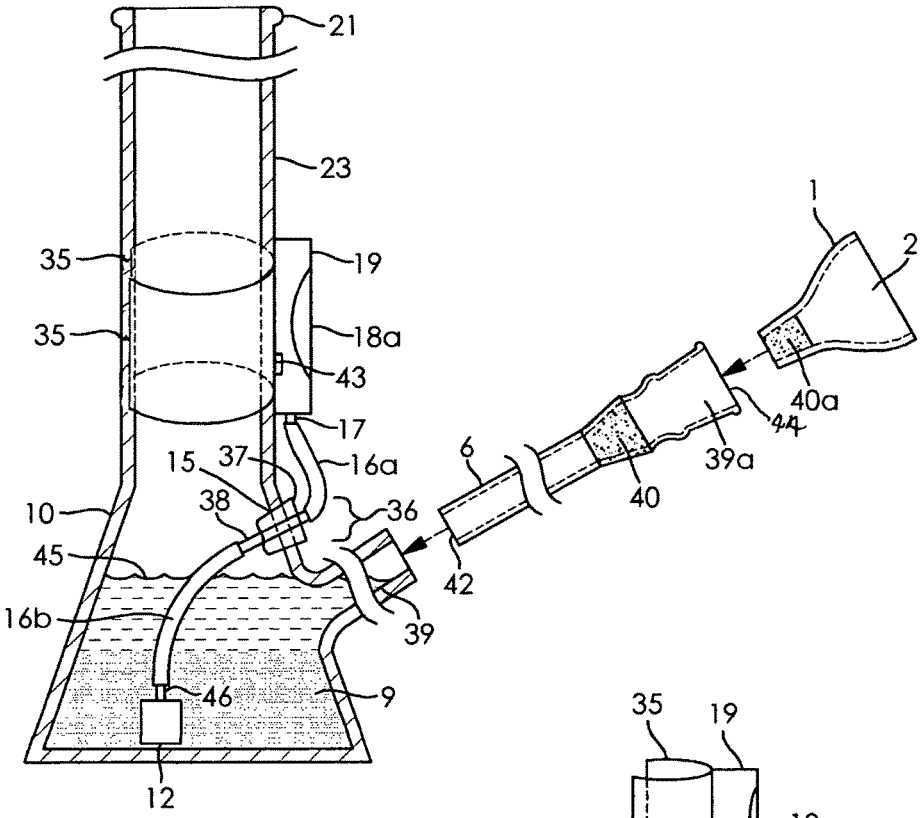
FIG. 4 is another embodiment of the invention wherein the pressurized gas supply enters the body of the water conditioned smoking device through a bung assembly which is lodged in the body of the device.

FIG. 4 depicts a further embodiment of a water-conditioned smoking device of the invention wherein the gas pump 19 is detachably mounted to the body 23 using a flexible clamp comprising two flexible wings 35 that open to allow the passage of the body 23 and which then close on the body 23 and embrace same, holding the pump 19 in place but allowing limited rotational movement about the circumference of the body 23. A flexible conduit 16*a* is in gas communication with the pump 19 and bung assembly 36. An optional disconnect release system such as a ring clamp (not shown) for detaching the flexible conduit 16*a* from air pump outlet 17 secures the flexible conduit 16*a* to the air pump outlet 17. Thus, the gas from pump 19 passes substantially through to the sparger 12. Pump 19 is turned on and off using a toggle switch 18*a*, positioned to be readily depressed by the user at the time the product in combustion bowl 2 is ignited. Pump 19 also optionally comprises an entertainment effects unit 43 (not shown in FIGS. 1-3) which turns on and off at substantially the same time as pump 19 as described further above. Effects unit 43 optionally is controlled by a digital storage and computing device (not shown) within the pump housing which controls the production of lights or sound effects including music. The pump 19 found in any of the other devices in the Figures described herein also is modified to encompass either or both of the entertainment effects unit and/or toggle switch 18*a*.

Bung assembly 36 typically comprises a plug 37 pieced by a rigid conduit 38 which accepts gas from flexible conduit 16*a* and allows passage of pressurized gas into conduit 16*b* and then sparger 12. The bung assembly 36 is adapted to reversibly and sealably engage opening 15 in the liquid retention chamber 10 of the water-conditioned smoking device. The diameter and character of the bung assembly 36 is selected so that it will lodge in opening 15 under suitable pressure but which can be removed from opening 15. The purpose of the reversible lodgment of the bung assembly is to permit removal of the pressurized gas distribution system from the device in order to clean or replace same.

The device of FIG. 4 optionally comprises a smoke transfer conduit 6 having a smoke receiving orifice 44 and a smoke discharge terminus 42, a ground glass male coupler 40 for reversibly and sealably receiving a female connector (not shown, see FIG. 4 for example) positioned in a water retention chamber (not shown; see FIG. 4 for example) of a water conditioned smoking device. The conduit 6 terminus 44 connects to a combustion bowl (not shown, see FIG. 4 for example) via a ground glass female member 39*a* which receives ground glass male connector 40*a* (see FIG. 4) located on a combustion bowl 1 whereby the combustion bowl communicates with the gas transfer conduit 6. Also within the scope of this invention is the subassembly of the device depicted in FIG. 4 which does not contain the gas transfer conduit 6 or bowl 1. In practice, these elements typically are sold separately.

The wings 35 optionally are replaced by other flexible clamping systems (not shown) such as one or more rubber bands, a Velcro brand loop-and-hook pair, snap cords or the like which retain the pump 19 in place but permit facile dismounting and reattachment of the pump. The flexible clamping systems like snap cords are passed over the orifice 21 and the pump 19 slid down the body, or the flexible clamping system comprises a mount such as an alligator clip or paired Velcro attachment system which is capable of being disconnected from the pump and to thereby release the same. These mounting systems are bonded or molded integrally into the housing for the pump (designated together with the pump as element 19 and not shown separately). Velcro systems are used by sticking a loop sheet on the device body and the complimentary hook sheet on the pump housing, or vice-versa. The same pump mounting systems described in this paragraph are suitably employed with any of the devices of FIGS. 1-3 and 5.

Also within the scope of this invention is a subassembly of the device depicted in FIG. 4 which comprises pump 19 with toggle switch 18*a*, a reversible connector such as wings 35 or alternatives as noted above for mounting the pump on a water-conditioned smoking device, an outlet 17 for air from the pump 19, a flexible conduit 16*a*, bung assembly 36 as described above, and flexible conduit 16*b* in communication with sparger 12. The flexible conduits are pressure fit on the sparger, bung conduit 38 and pump outlet 17, or are held in place with connectors such as band clamps.

In the device of FIG. 4 the pump 19 is mounted on the body of the device 23 for conveniently grasping the smoking device and, as required, actuating the switch 18*a* for turning on the pump. The pressurized gas distribution mechanism (elements 16*a*, 36, 38, 16*b*, 46 and 12) is constructed to facilitate its replacement when desired, i.e., the conduit 16*a* is connected to pump outlet by a hose clamp or by pressure fitting the conduit 16*a* so it can be reversibly dislodged from pump outlet 17. The body 23 has a hole 15 emplaced to receive the bung assembly 36, the hole 15 having a diameter which is adequate to allow passage of the sparger 12 and flexible conduit 16*b* through the hole 15 but which is small enough to sealably fit the bung assembly in hole 15. In use, when the sparger 12 becomes contaminated with smoke residue it is easily replaced by simply dislodging the bung assembly 36 and disconnecting the hose 16*a* from the pump. The withdrawn contaminated sparger or gas distribution system is then replaced with a clean one.

Figure 5:
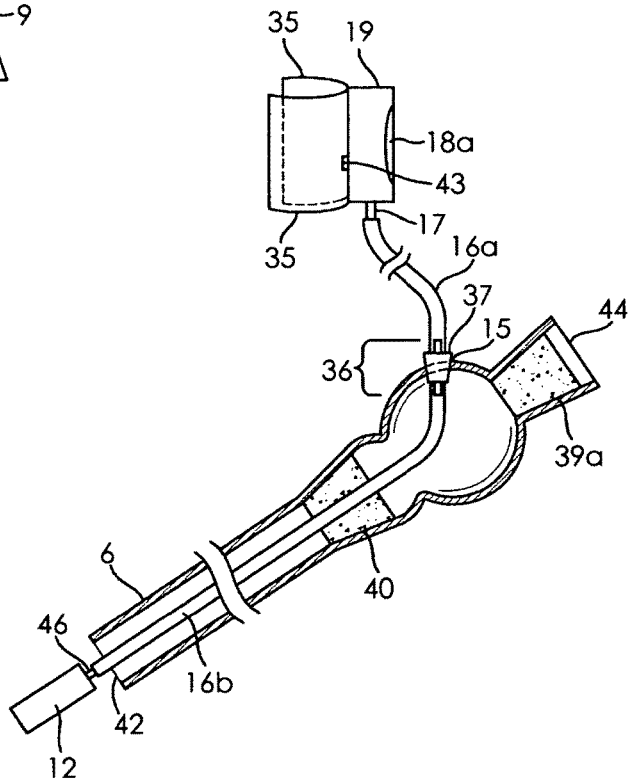
FIG. 5 is an embodiment of the invention which is an accessory for practicing the invention and which is adaptable to a variety of separate water conditioning smoking devices.

FIG. 5 depicts an embodiment of the invention, a water conditioned smoking device accessory wherein the sparger is lodged in the water bath via a modified smoke transfer conduit or tailpiece. All the elements are the same as described above in respect to FIG. 4. However, in this embodiment the bung assembly 36 is lodged in an opening 15 in the tailpiece rather than in the body 23 of a water-conditioned smoking device. This offers the advantage of achieving the benefits of the invention by modifying merely an accessory element of a water-conditioned smoking device rather than the body of the device. Modifying accessories permits the invention to be used with a wide variety of smoking devices.

In the device of FIG. 5 the opening 15 is sufficiently large in diameter as to allow threading the sparger 12 into the tail piece at any position between the male coupler 40 and the smoke receiving orifice 44, and down the length of the tail piece until it has extended through terminus 42. The length of 16*b* is such that when the tail piece is inserted into the water-conditioned smoking device liquid retention chamber 10 both of the sparger 12 and the terminus 42 of the tail piece will be below the surface of the conditioning water bath when the conduit 6 is sealably engaged and in gas communication with the water retention chamber 10. Preferably the sparger is positioned immediately proximal to the terminus 42.

An accessory for a water conditioned smoking device comprises (a) a source of pressurized gas having a mount for reversibly attaching the source of pressurized gas to a water conditioned smoking device, (b) a first pressurized gas conduit for transferring pressurized gas from the source of the pressurized gas to a smoke transfer conduit, said smoke transfer conduit comprising (A) a smoke receiving orifice, (B) a connector for reversibly and sealably connecting the smoke receiving orifice to a combustion chamber whereby smoke is passed into the accessory from the combustion chamber via the smoke receiving orifice, (C) a connector for reversibly and sealably connecting the smoke transfer conduit to a water conditioned smoking device, and (D) a second pressurized gas conduit disposed substantially coaxially along the axis of said smoke transfer conduit which second conduit is (i) in gas communication with the first pressurized gas conduit, and (ii) sealed from the interior of the smoke transfer conduit.

A further embodiment of this accessory invention comprises (a) a tailpiece having a smoke outlet and a smoke inlet, which tailpiece comprises a gas transmission conduit having a length suitable to position the smoke outlet below the surface of the conditioning water bath in a water-conditioned smoking device, (b) a bung assembly, said bung assembly comprising (i) a plug and (ii) a conduit having a first and second terminus which passes through the plug and is sufficiently rigid that inserting the bung assembly in a constricting opening will not collapse the conduit, (c) an opening in the tailpiece which engages and holds in place the bung assembly, said opening being different from the smoke inlet and located between (i) the smoke inlet and (ii) a connector disposed on the tailpiece for engaging a mating connector on a water-conditioned smoking device, (d) a first flexible conduit capable of gas communication with a pump and the first bung conduit terminus, (e) a second conduit in gas communication with the second bung conduit terminus, said second conduit disposed inside the tailpiece and (f) a sparger in gas communication with the second flexible conduit. The second conduit is flexible (polymer) or may be glass or other inert material. Other embodiments further comprise (i) a gas pump for supplying air or other gas to the first flexible conduit and/or (ii) a device for making sounds and/or light as further described above. The invention also is provided in the form of a kit comprising (A) the tailpiece having elements (a)-(f) and (B) the pump (which in turn optionally comprises the entertainment unit).

A subassembly of this invention is an ash catcher comprising a combustion chamber, a conditioning water retention chamber having a water retention level, a smoke transfer conduit terminating below the water retention level in the conditioning water chamber and a smoke discharge member wherein the gas discharge member is capable of sealingly communicating with a water conditioned smoking device, a gas conduit for conducting pressurized gas to a point below the water retention level in the conditioning water chamber, and a pump for pressurizing gas communicating with the gas conduit.

In an embodiment related to ash catchers the pressurized gas source communicates with a secondary conditioning water retention chamber (the chamber most proximal to the sampling port), in another embodiment it communicates only with the ash catcher, or primary, conditioning water retention chamber, and in a further embodiment communicates with both of the conditioning water retention chambers, one in the ash catcher and the other in what is now the water conditioned smoking device subassembly. In this third embodiment, the conduit 16 is split prior to entering the device, one branch going into the liquid retention chamber and the other into the liquid retention chamber of the ash catcher. These branches are optionally controlled by valves (not shown) that are adjusted by the user to set the flow of gas to the desired level.

Users typically supply their own combustion chambers so the devices of the invention need only a connector for reversibly and sealably engaging a bowl or combustion chamber, but not the bowl or combustion chamber itself. In general, water conditioned smoking devices have only two openings to the outside atmosphere, the inhalation orifice and an orifice for accepting smoke. Otherwise, they are substantially sealed to the atmosphere and are essentially devoid of any other openings. In the devices of this invention, as noted, a third opening is provided that enables supply of pressurized gas. Optionally a valve is interposed between the combustion chamber and the liquid retention chamber for controlling passage of smoke into the device.

As seen by the embodiments above, the pressurized gas is supplied via several routes into the interior of the device and/or an ash catcher mounted thereon. When the interior of the smoking device is readily accessible the gas is transferred via a conduit which passes through an opening in the body of the smoking device that is about the same size as the conduit (FIG. 1), while in others it passes through a bung lodged in an opening in the body of the device (FIG. 4) or in an opening in an accessory or subassembly such as the base (FIG. 2), an ash catcher (FIG. 3) or a tailpiece (FIG. 5). Other routes for introducing pressurized gas into liquid conditioned smoking devices will be apparent to the ordinary artisan and are used in the practice of this invention. Accessories or subassemblies are elements of the smoking device that are reversibly detachable and, in many instances, are separately sold. Employing the invention in accessories or subassemblies is a commercially preferred embodiment because these elements are less expensive and thus provide a more facile entry into use of the invention, i.e., they are substitutable for elements on devices already purchased thereby obviating the need to buy an entire water conditioned smoking device comprising the invention.

In other embodiments the switch also activates lights and/or speakers, for example a series of lights and sounds or music constituting a show. A show is a programmed musical and/or lighting presentation which serves to entertain and amuse. Ordinarily the lights and/or speakers are located on or within the pump housing, but it is also within the scope hereof to provide an audio output or a signal device (for example equipment providing a wireless emission) which actuates an external audio device such as an amplifier or other conventional music playing equipment. Generally a low voltage light such as an LED is mounted on the portion of the pump housing that is adjacent to the body of the device so that the light will illuminate the smoke within the device. In view of the individual nature of such shows, the invention also comprises a programming device (for example an iPod-like device) or programming input node for receiving such programming. In embodiments, the music and lighting features are external to the device except for the switching function associated with the pump and a sending function for controlling the sound and music presentation using equipment external to the smoking device.

As noted, the pump is disposed in a housing with the components noted above together with a power supply such as batteries or power jack. Any housing is suitable and may embrace decorative features such as sculptural elements and the like. The housing is made of any material but usually is a thermoplastic resin such as polystyrene or polyurethane. The pump and its housing are generally mounted reversibly to the body of the water conditioned smoking device.

The water conditioned smoking device of this invention further comprises additional features, comprising (a) a sparger communicating with the source of pressurized gas and oriented such that it is located below the level of water in the conditioning bath whereby the gas stream is divided into a plurality of fine streams, and/or (b) a gang switch that simultaneously starts the supply of pressurized gas upon inhalation through the inhalation orifice and optionally initiates a light show illuminating the device or portion thereof. The gang switch is manually activated by finger pressure or, more conveniently, by a vacuum switch actuated by the negative pressure in the smoke retention chamber as a result of the user's act of inhalation.

The pressurized gas is usually air, although it is within the scope hereof to include flavorants and scents such as menthol. It generally does not contain any smoke. In an alternative embodiment, a "pressurized" gas like air is delivered by applying a vacuum to the smoke retention chamber so as to draw gas into the water bath, conditioning the smoke, stopping the vacuum and then inhaling the smoke. Thus, the device optionally would be modified so that a vacuum pump is used with the smoke retention chamber rather than a positive pressure pump 19 sending gas into the liquid retention chamber, with the user inhaling in concert with the output of the vacuum pump.

The source of pressurized gas typically is a positive pressure pump (its outlet supplies positive pressure rather than a vacuum), but may instead be a valved canister if a particular gas mixture is desired. The gas source communicates with the liquid retention chamber via a gas transfer tubing made out of flexible material such as polypropylene such as that heretofore used for aquarium air supplies. When the flexible gas conduit will be exposed to hot smoke (as with the smoke conduit 16*b* in FIG. 5) one can employ a line made out of glass or other substantially inert material.

In another option, the gas supply is controlled by a valve in conduits 16 or 16*a* (not shown) which is set by the user to control the volume or pressure of gas. The exact parameters of the pump, valves (if any) and gas (volume, pressure and the like) will depend upon the back pressure of the conditioning bath, the internal configuration of the smoking device and/or ash catcher and user preference. It will be understood that "pump" as used herein also comprises the housing as required by context. Suitable electrical (particularly battery operated portable) pumps are well known in the aquarium art, for example.

The pressurized gas supply typically terminates in a diffuser, jet or frit aerator or sparger, herein referred to generally as a "sparger". The sparger is disposed in the conditioning water retention chamber below the water level (45 in FIG. 4, for example). Generally all of the pressurized gas is passed through the sparger and into the conditioning water retention chamber below the water level. Suitable spargers are air stones, compressed glass frits, porous metal or and other formed objects, diffusion mesh, porous membranes, nozzles or the like through which pressurized gas flows and produces a mass and/or stream of fine bubbles in the conditioning bath. These devices are commonly available, for example as aerators for use in aquariums. Air stones typically consist of or comprise a nipple or spud conduit 46 for communicating with and connection to the gas supply conduit, a shell (typically fully enclosing the gas supply) made of porous material capable of generating fine bubbles, and a chamber (not shown) for distributing gas from the conduit or nipple into the shell.

The pump and its housing further comprise a mounting system for securing the pump to the outside of the smoking device, the mounting usually being on the side of the pump housing which is substantially opposite to the switch controlling the pump. In use, the pump is secured to the body of the water-conditioned smoking device ("body side" of the pump). In one embodiment the reversible mounting or a flexible clamping system is mounted on the body side of the pump housing and the switch is disposed on substantially the opposite side of the pump (see switch 18*a* in FIG. 5). Here, gripping the pump and body activates the pump when the switch is depressed. Alternatively, the switch is mounted on the body side of the pump so that compressing the pump housing against the body of the water-conditioned smoking device depresses the switch and turns the pump on. The switch usually is a toggle switch, so that one depression turns the pump on and the next turns it off, in series. As noted above the pump also comprises a light and/or sound making device 43 preferably controlled by the switch in tandem with the pump. The light ordinarily is disposed on the body side of the pump so that it illuminates the smoke retention chamber. The pump is not a high capacity pump since only a small volume of air is necessary to aerate the conditioning water bath while inhaling from the smoking device.

In not all embodiments does the gas supply conduit directly terminate in a sparger. It may simply terminate in the liquid retention chamber with the sparger being located within the smoke passage between the liquid retention chamber and the inhalation orifice. The "disc pipes" referred to in the Background are modified in accord with this embodiment by introducing the pressurized gas into the liquid bath without a sparger at the end of the pressurized gas conduit. The desired aeration occurs when the introduced gas and the smoke pass through the disc frits mounted across the span on the pipe body in this class of devices. In this embodiment a one-way valve is optionally mounted in the gas conduit to prevent backflow of liquid from the liquid bath.

The relationship between the sparger and smoke input within the water bath may vary considerably. Typically, the sparger is loosely mounted in the water bath below the point at which smoke enters the water bath (e.g. terminus 42 in FIG. 2) and in close proximity to the smoke entry (terminus 42).

The gas supply pump typically is reversibly mounted on the body of the device, usually the base or the side thereof, so it can be removed for maintenance and battery replacement. The pump is turned on or actuated at the user's initiative (whether directly or indirectly). The switch, typically a toggle switch, is actuated by (a) finger pressure which both turns the pump on and off, (b) hand pressure applied while gripping the pump (here the pump comprises an exposed pressure activated switch so that the user's hand pressure or grip turns on the pump and relaxation of pressure turns it off), (c) an air pressure-sensitive switch mounted inside the device (not shown in the figures) that turns on when the smoker inhales from the device and produces negative pressure inside the device, i.e., the smoker's inhalation of conditioned smoke initiates the supply of pressurized gas to the liquid retention chamber and continues so long as the smoker continues to inhale, and/or (d) a temperature sensitive switch mounted on the combustion bowl that is activated by combustion of the material in the combustion bowl, and which turns off the pump when the heat of combustion diminishes. Other methods for switching on the pump in tandem with, for example, inhalation, pressure reduction or heat of combustion will be apparent to the skilled artisan. In other embodiments the pump is turned off not by any of the foregoing measures but simply by a timer which is factory set or which is adjustable by the user. A toggle switch turns on when depressed or actuated, then turns off when depressed or actuated the next time, and so on in series.

In general, the amount of pressurized gas to be transferred into the device over time is at least equal to the volume of smoke that is to be inhaled from the smoke retention chamber. The rate of supply is equal to or greater than the rate of inhalation, i.e., the volume and rate of air supply is a function of the smoker's inhalation of smoke from the smoke retention chamber. This of course will depend upon the smoker and the volume and configuration of the smoking device and can be determined by the artisan by routine experimentation. The excess of volume and rate of air supply over the unaided smoker's inhalation is about from 5% to 50%, typically 5% to 25%, more typically 5% to 15%. In this respect the source of pressurized gas optionally serves to assist pulmonary intake by the user.

The pressurized gas is supplied to the conditioning water bath at ambient temperature or may be heated or cooled depending upon the user's choice. The gas supply is cooled by passing the gas supply conduit through a coolant source such as a chilled water bath or ice container, or heated by passing the conduit through an electrically heated pad or warm water bath. The temperature of the pressurized gas at the conditioned water bath suitably ranges from about 5 degrees C. to about 25 degrees C.

The devices of this invention are typically are provided without conditioning fluid since this is added by the user prior to smoking and changed out afterwards. However in embodiments the devices of this invention contain conditioning fluid. The conditioning fluid is generally water, although aqueous solutions are suitable, for example solutions containing salts that would increase the solubility in the liquid bath of undesirable charged substances in the smoke. It will be understood that "water" as used herein means any liquid comprising water, e.g., aqueous solutions, purified water, emulsions, suspensions, and/or organic solvents such as ethanol. The pH of the bath liquid ranges from 4 to 5, 5 to 6, 6 to 7, or 7 to 8 and optionally is buffered. The liquid optionally contains suspensions of solids which aid in conditioning the smoke. For example, the liquid is charged with pellets of ion exchange resins (strongly or weakly acidic, or strongly or weakly basic) having affinity for negatively or positively charged combustion products. A suspension of activated carbon is another agent suitable for inclusion in the liquid bath.

The devices of this invention are easily manufactured. The device shown in FIG. 1 was made by drilling a hole in the housing or casing or body 23 of the device at 15 and passing the gas supply conduit through it. The fit of is sufficiently tight that little or no gas or smoke could pass alongside the conduit. The devices of FIGS. 2-5 are made in similar fashion, although the devices of FIGS. 3-5 have a bung assembly or system to seal the larger holes needed to accommodate passage of the sparger.

Hole or opening 15 is placed in the body 23 by molding in place during manipulation of molten glass body 23 during its manufacture (this would facilitate use of a ground glass connector), or by drilling holes using abrasive bits or abrasive jet cutting systems or laser cutting depending upon the material concerned. The manner in which the hole or opening is produced is not critical provided it works with other elements to produce a substantially gas-tight seal and permits removal and insertion of the conduit 16 or bung system 36. A ground glass connector is depicted, for example, in FIGS. 4 (39-40 and 39*a*-40*a*) and is well known in the art.

The user operating the water conditioned smoking device of this invention fills the desired liquid into the liquid retention chamber(s) until the smoke input is situated below the surface of the liquid. The user loads herbaceous smoking material into the combustion chamber and ignites same while drawing on or inhaling from the inhalation orifice. The device is operated in the same way when an ash catcher of this invention has been connected to the water conditioned smoking device. Smoke passes through the smoke transfer conduit and bubbles into the liquid retention chamber, and then into a conditioned smoke retention chamber. As the smoke begins to enter the liquid retention chamber the user turns on the pump and air is supplied to the water bath. If an ash catcher is mounted on the device then the pump preferably is turned on when smoke begins to bubble into the liquid retention chamber of the ash catcher. The timing of inhalation and turning on the source of pressurized gas is a matter of user preference. Conditioned smoke ultimately accumulates in smoke retention chamber 14. This conditioned smoke is inhaled through the inhalation orifice as the user desires. The pump can be run continuously through several inhalation cycles or discontinued after each smoking exercise, again at the user's discretion. The practice of this invention produces cooler and more thoroughly conditioned smoke.

I claim:

1. A liquid conditioned smoking device comprising (a) an enclosed body having an inhalation orifice and a smoke receiving orifice for gas communication with a combustion chamber, (b) a connector for reversibly and sealably connecting the smoke receiving orifice to a combustion chamber whereby smoke is passed into the device from the combustion chamber via the smoke receiving orifice, (c) a liquid retention chamber and a conditioned smoke retention chamber, the smoke receiving orifice being in gas communication with the liquid retention chamber, the liquid retention chamber being in gas communication with the conditioned smoke retention chamber, and the conditioned smoke retention chamber is in gas communication with the inhalation orifice, (d) a source of pressurized gas in gas communication with the liquid retention chamber, and wherein the liquid retention chamber comprises a top section and a bottom section, the bottom section being capable of being removed from the top section and the source of pressurized gas being mounted on the bottom section.

2. The device of claim 1 wherein the source of pressurized gas is a pump.

3. The device of claim 2 wherein the pump is reversibly mounted.

4. The device of claim 2 wherein the gas is air and the pump is actuated by a switch along with a lighting device and/or a device for making sound.

5. The device of claim 2 wherein the connector is a ground glass connector.

6. The device of claim 2 further comprising a light which is turned on when the pump is turned on.

7. The device of claim 2 further comprising a frit body fully spanning the liquid retention chamber between the conditioned smoke retention chamber and the smoke receiving orifice, and wherein the source of pressurized gas communicates with the liquid retention chamber between the frit body and the smoke receiving orifice.

8. The device of claim 2 further comprising a speaker for sound effects which are turned on when the pump is turned on.

9. The device of claim 2 wherein the pump is powered by battery.

10. The device of claim 2 wherein the pump comprises a switch for turning the pump on and off which is actuated by (a) finger pressure, (b) hand pressure applied while gripping the pump, (c) vacuum within the device caused by a smoker inhaling from the device through the inhalation orifice, and/or (d) detection of combustion in the combustion chamber.

11. The device of claim 10 wherein the switch is a toggle switch.

12. The device of claim 2 further comprising a sparger in gas communication with the pump and disposed within the liquid retention chamber.

13. The device of claim 12 wherein the device further comprises a flexible conduit between the pump and the sparger.

14. The device of claim 13 wherein the flexible conduit passes through a bung reversibly mounted in the body of the device.

* * * * *